United States Patent [19]

Walk et al.

[11] Patent Number: 4,832,135

[45] Date of Patent: May 23, 1989

[54] FLOW THROUGH RAISE BORING BIT

[75] Inventors: Howard J. Walk; Gregory L. Hern, both of Arlington, Tex.

[73] Assignee: Baker Hughes Incorporated, Grand Prairie, Tex.

[21] Appl. No.: 162,170

[22] Filed: Feb. 29, 1988

[51] Int. Cl.[4] ..... E21B 10/10; E21B 10/20; E21D 3/00

[52] U.S. Cl. ..... 175/53; 175/325; 175/357

[58] Field of Search ..... 175/53, 357–364, 175/325

[56] References Cited

U.S. PATENT DOCUMENTS

| | | | |
|---|---|---|---|
| 3,858,667 | 1/1975 | Goodfellow | 175/53 |
| 4,142,598 | 3/1979 | Maxsted | 175/344 |
| 4,381,038 | 4/1983 | Sugden | 175/53 |
| 4,456,082 | 6/1984 | Harrison | 175/384 |
| 4,697,652 | 10/1987 | Walk | 175/325 |

*Primary Examiner*—Stephen J. Novosad

*Attorney, Agent, or Firm*—Robert A. Felsman

[57] ABSTRACT

An improved raise boring bit to enhance cuttings removal and prevent accumulation of cuttings on the body of the bit, which utilizes a pair of radial rails and a plate connected with and strengthening the rails while defining an opening for the flow of cuttings beside the stem and the radial rails during boring. Cutter mounting means are disposed at intervals along the radial rails to permit the flow of cuttings between the rails and the mounting means. At least one wing extends radially from the plate for supporting additional cutters, a vertical stabilizer roller is mounted on the end of the wing and struts extend between adjacent sides of the wings for stability and support.

10 Claims, 3 Drawing Sheets

FLOW THROUGH RAISE BORING BIT

BACKGROUND OF THE INVENTION 1. Field of the Invention

This invention relates in general to raise boring or box hole drilling bits and in particular to improvements to enhance cuttings removal. 2. Background Information In the raise boring method or process a large diameter bit body, upon which rotatable cutters are dispersed, is pulled upwardly and rotated by a drill string attached to a stem that protrudes upwardly from the bit body.

Cuttings formed while raise boring fall downwardly against the bit body and, in the past, accumulated to the extent to sometimes impede progress. The same problem can exist in box hole drilling.

Various attempts have been made to prevent the accumulation of cuttings on the bit body and around the rotatable cutters. Some of the solutions of the past involve the formation of openings in the bit body to permit the flow of cuttings through the bit body and prevent accumulation. Even though progress has been made toward solving this problem, there still exist a cuttings accumulation problem in the immediate vicinity of the cutters. This can lead to a variety of problems, including damage to the seals used to contain lubricant in the bearings that supports the cutters.

There is, as a consequence, need for additional improvement in raise boring or box drilling bits to prevent the accumulation of cuttings around the rotatable cutters supported on the bit body.

SUMMARY OF THE INVENTION

It is therefore, the general object of the invention to provide a raise boring bit with improved means to prevent the accumulation of cuttings on the bit body.

The above and additional objects of the invention are achieved with an improved raise boring bit which includes a stem to define the central axis of the bit. At least one pair of radial rails extend from the central axis. A plate is connected with and strengthens the radial rails, extending around the stem and spaced radially to define an opening for the flow of cuttings. Cutter support means are disposed at selected intervals along a pair of radial rails. Therefore, cuttings may flow between the rails and the support means to lessen the problem of cutting accumulation. Cuttings may thus flow during raise boring in the opening beside the stem and the parallel rails and also between the radially support means and the rails. In the preferred embodiment of the invention at least one wing extends radially from a plate to support additional cutters, and a vertical stabilizer roller is mounted on the end of the wing. Also in the preferred embodiment the cutter support means are disposed at selected intervals along the rail outwardly from the stem. Some of the support means are arranged in tandem to support opposed ends of two bearing shafts. The plates are arranged in a preferably polygon shape, with a wing attached to each plate. The wings are strengthened by struts attached to adjacent sides.

Additional objects, features and advantages of the invention will become apparent in the following description.

DESCRIPTION OF THE PREFERRED EMBODIMENT

Figure 1:
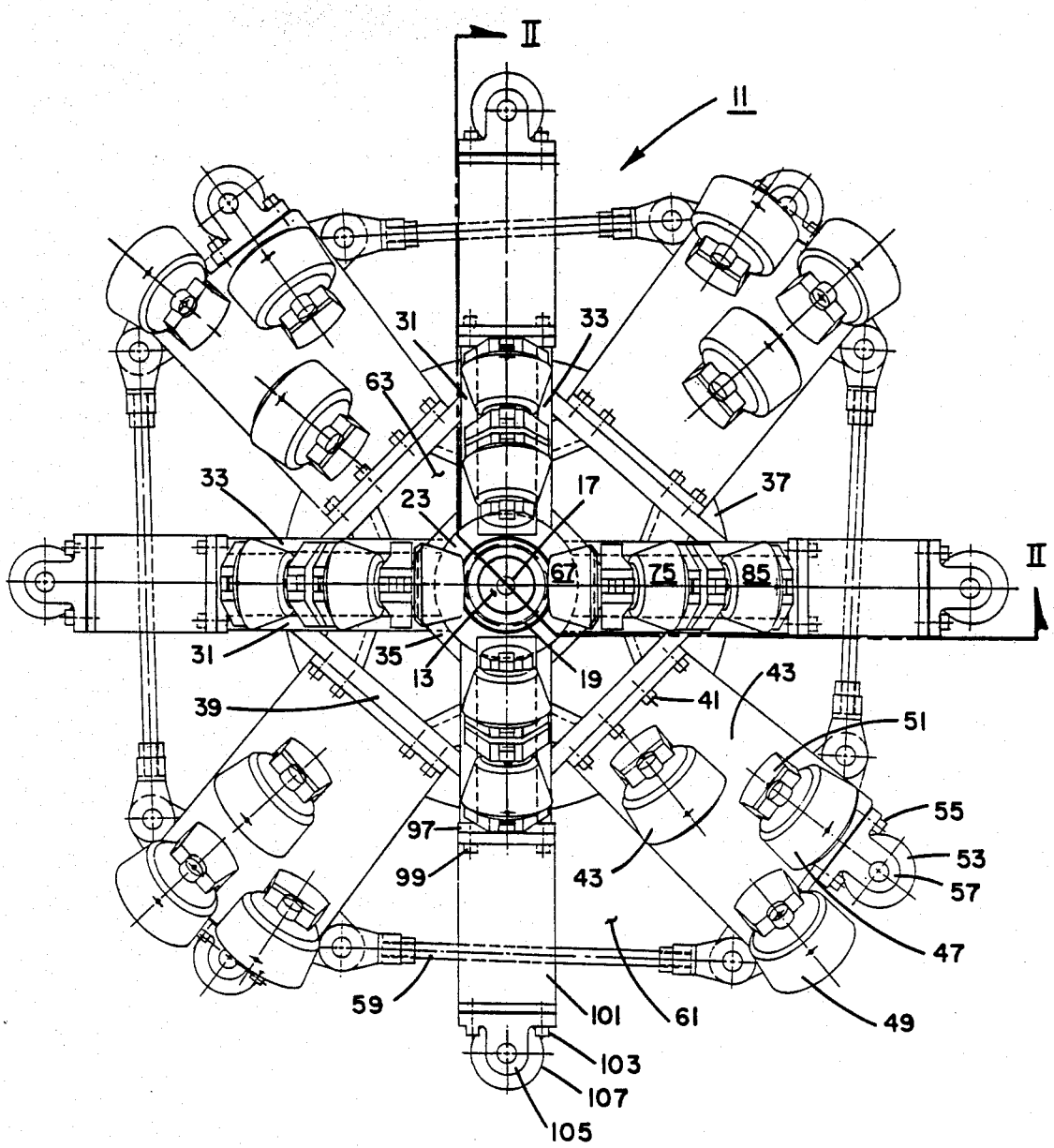
FIG. 1 is a plan view looking downwardly on a raised boring bit which is constructed in accordance with the principles of the invention.

The numeral 11 in the drawing designates a raise boring bit which includes a stem 13 with a threaded upper end 15 and a drilled hole 17. The upper end 15 is adapted for connection to a raise boring machine (not shown) and contains a drilled hole 17 to permit some flexing of the stem to reduce fatigue failures.

A wear pad 19 is included on an intermediate region of the stem to reduce wear as the stem is pulled upwardly and rotated in a pilot hole.

Figure 2:
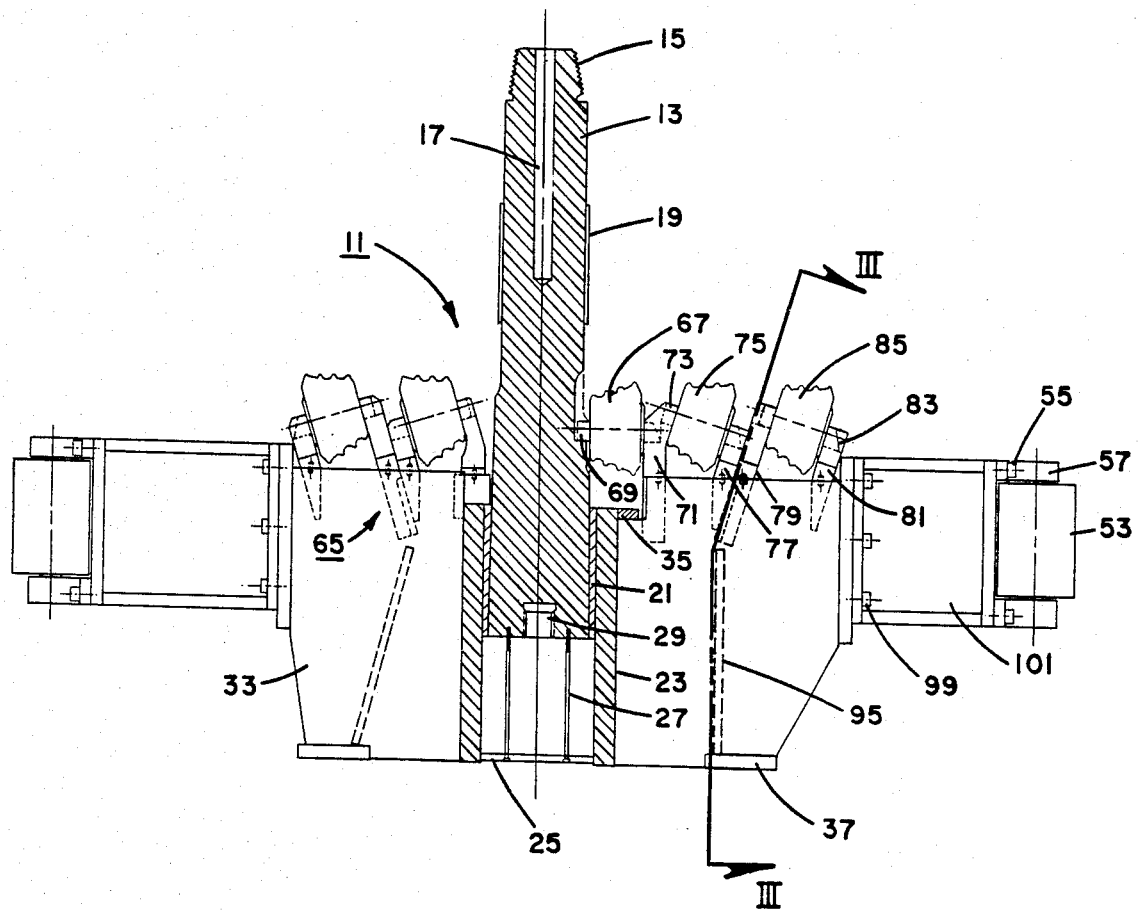
FIG. 2 is a side elevational view, partially in section, as seen looking along the lines II—II of FIG. 1.

As best seen in FIG. 2, the stem is held by a taper locked sleeve 21 to a hub 23. A cover plate 25 is secured by fasteners 27 to the lower end of the stem 13 to keep a portion of the interior of the hub clean to receive a hydraulic piston that is used to install or remove the stem 13 from the sleeve 21.

The lower end of the stem 13 has a threaded opening 29 to facilitate handling of the stem or extraction of the stem.

Connected to the hub 23 are pairs of radial rails 31, 33. There are four pairs of such rails shown in the FIG. 1 embodiment arranged at 90° angles, the inner ends of which are welded to the hub 23 and strengthened by a plate or sections of a plate 35.

As seen in FIG. 2, there is a bottom plate or ring 37.

As seen in FIG. 1, each of the radial rails 31, 33 are intersected by a plate 39. Actually, there are four plates 39 arranged in a polygon shape, the ends of which are intersected in the corners by radial rails 31, 33. Plates 39 are welded to the sides of adjacent rails 31, 33. In addition to strengthening the rail 31, 33, the plates 39 are for attachment by suitable means such as bolts 41 of a plurality or series of radially extending wings 43 upon which are supported a plurality of rotatable cutters 45, 47, 49 cutter support means or lugs 51. A vertical stabilizer roller 53 is mounted on the outer end of wing 43 by means such as bolts 55 and stabilizer support means 57. To add strength and stability to the bit, a plurality of struts 59 are secured to outer end regions of the wings 43.

From the above description, it is clear that there are a plurality of openings 61 around or adjacent to the outer periphery of the bit body to permit the flow of cuttings downwardly during raise boring. Also, the plate 39 connects and strengthens the radial rails 31, 33 and define a series of openings 63 to permit the flow of cuttings beside the stem 13 and the radial rails during boring.

Figure 3:
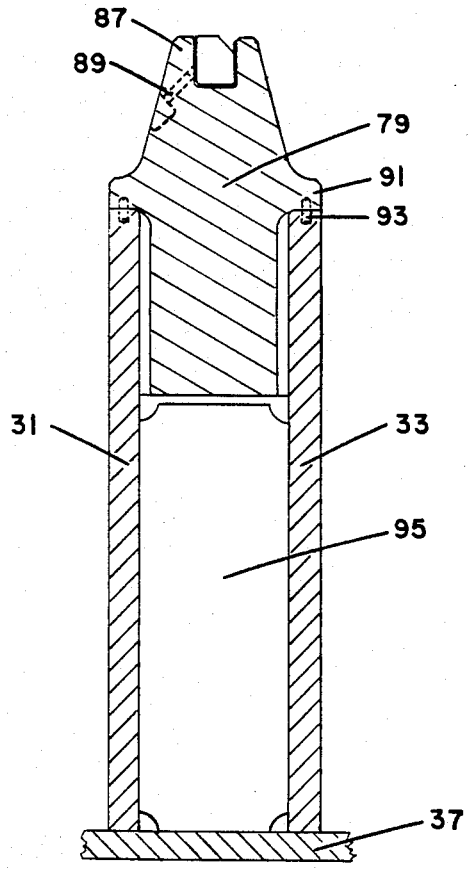
FIG. 3 is a view, partially in section as seen looking along the line III—III of FIG. 2, showing a preferred form of mounting means used to mount a bearing shaft and associated rotatable cutter.

Cutter mounting lugs 65, as best seen in FIG. 2, are disposed at intervals along the radial rails 31, 33 outwardly of the stem 13 to form pairs of radially spaced lugs for the flow of cuttings during boring. As shown in FIG. 2, the innermost cutter 67 has a bearing shaft 69 with an inner end that abuts the stem as further described in U.S. Pat. No. 3,638,740. The outer end of the bearing shaft 69 is supported in or by a lug 71, which in this instance is a tandem lug that also supports the inner end of another bearing shaft 73 of the rotatable cutter 75. The opposite end of bearing shaft 73 is supported by outside lug 77 which is welded inside lug 79. Inside lug 79 and outside lug 81 support the bearing shaft 83 used to support the rotatable cutter 85. The lugs preferably have the configuration shown in FIG. 3, in which lug 77 is shown with its upper end 87 configured to include a bolt hole 89 as further described in U.S. Pat. No. 3,749,188.

An intermediate region of the lug 79 has a shoulder 91 having a dowel hole to mount with a dowel pin 93 extending from each radial rail 31, 33 for proper alignment and location. A gusset 95 extends downwardly along the rail 31, 33, as best seen in FIG. 2, being welded to the bottom bolt plate 37 and the rails.

At the ends of the rails 31, 33 is a plate 97 (see FIG. 1) to which is fastened by bolts 99 a stabilizer wing 101. To the end of wing 101 is secured a stabilizer roller 107 by means of a stabilizer support 105 with bolts 103. There are four such wings in the FIG. 1 embodiment.

In operation, the raise boring bit 11 is connected by the threaded upper end 15 of the stem 13 to a drill string and raise bore (not shown). The raise bore rotates the drill string and raise boring bit 11 and thrust upwardly such that the rotatable cutter such as 67, 75 and 85 of FIG. 2 disintegrate the engaged earth and form cuttings which fall downwardly into a tunnel where they may be conveniently removed by rail car or otherwise. Some of the cuttings fall between the radial rails 31, 33 and the cutter mounting means or lugs 71, 77 or 79, 81 shown in FIG. 2. As a consequence, detrimental build-up of cuttings beneath the rotatable cutter is minimized and drilling or boring is unimpeded. Additional cuttings may flow in the spaces 63 between the bolt plate 39 and the adjacent sides of the radial rails 31, 33. Still other cuttings, especially those from the outer most cutters 45, 47, 49 may flow through the spaces 61 between the wings 43 and struts 59. The invention therefore has advantages in providing for the efficient flow of cuttings from the innermost to the outermost regions of the bit to enhance cuttings removal and boring efficiency.

While the invention has been shown in only one of its forms, it should be apparent to those skilled in the art that it is not thus limited but is susceptible to various changes and modifications without departing from the spirit thereof.

We claim:

1. An improved earth boring bit to enhance cuttings removal while drilling upwardly comprising:

a stem defining the central axis of the bit, one end adapted for connection to a drilling machine;

at least one pair of spaced apart radial rails extending outwardly from the stem, with a space on each side for the unobstructed flow of cuttings;

an axially extending plate connected with and strengthening the pair of radial rails by extending around the stem and being spaced therefrom to define said space for the flow of cuttings beside the radial rails during boring;

cutter support means disposed in a line along the radial rails and adjacent said space for the flow of cuttings during boring;

a bearing shaft supported by said support means;

a rotatable cutter mounted on the bearing shaft to face upwardly;

whereby cuttings may flow through the opening and between the rails during boring.

2. The invention defined by claim 1 which further comprises a wing extending radially from the axially extending plate and at least one rotatable cutter mounted on the plate at a position radially outside the cutter mounted on said cutter support means.

3. The invention defined by claim 2 which further comprises a vertical stabilizer roller mounted on the outer end of the wing.

4. An improved earth boring bit to enhance cuttings removal comprising:

a stem defining the central axis of the bit, the upper end adapted for connection to the drill string of a raise bore and another portion defining a body to support earth boring cutters;

pairs of radial rails extending outwardly at selected angles from the hub or central member of the body;

a plate connected with and strengthening the radial rails by extending around the stem and being spaced radially therefrom to define openings for the flow of cuttings beside the stem and radial rails during boring;

cutter mounting lugs disposed at selected intervals between the pairs of radial rails to increase rigidity, some of which form pairs of radially spaced lugs between which cuttings may flow during boring;

at least one lug supporting opposed ends of two bearing shafts;

a rotatable cutter mounted on each bearing shaft to face the upper end of the stem;

whereby cuttings may flow during boring beside the stem and the radial rails, and also between the radially spaced lugs to enhance cuttings removal.

5. The invention defined by claim 4 which further comprises plural wings, each extending radially outward from the plate and at least one rotatable cutter mounted on each plate.

6. The invention defined by claim 5 which further comprises a vertical stabilizer roller mounted on the outer end of each wing.

7. An improved raise boring bit to enhance cuttings removal comprising:

a stem defining the central axis of the bit, the upper end adapted for connection to the drill string of a raise bore and another portion defining a body to support earth boring cutters;

a plurality of pairs of space apart rails radiating outwardly from the stem;

an axially extending polygon shaped bolt plate with corners connected with and strengthening the radial rails, and having generally planar sides spaced radially from the stem to define openings for the flow of cuttings beside the stem and radial rails during boring;

cutter mounting lugs disposed at intervals along the radial rails to form pairs of radially spaced lugs between which cuttings flow during boring;

a bearing shaft supported by each said pair of lugs;

a rotatable cutter mounted on each bearing shaft;

whereby cuttings may flow during boring beside the stem and the radial rails, and also between the radially spaced lugs to enhance cuttings removal.

8. The invention defined by claim 7 which further comprises plural wings, each extending radially outward from the planar surface of the plate, with at least one rotatable cutter mounted on each plate.

9. The invention defined by claim 8 which further comprises a vertical stabilizer roller mounted on the outer end of each wing.

10. The invention defined by claim 9 which further comprises struts extending between the ends of adjacent wings for stability and support.

* * * * *